US005122074A

United States Patent [19]

Maag et al.

[11] Patent Number: 5,122,074

[45] Date of Patent: Jun. 16, 1992

[54] FLOURESCENT LAMP HOLDER MOUNT

[75] Inventors: Hans Maag, Crestwood; Gino J. Ciancanelli, Bayside, both of N.Y.

[73] Assignee: Voltarc Technologies Inc., Fairfield, Conn.

[21] Appl. No.: 794,950

[22] Filed: Nov. 20, 1991

Related U.S. Application Data

[63] Continuation of Ser. No. 565,271, Aug. 9, 1990.

[51] Int. Cl.[5] ..... H01R 33/02

[52] U.S. Cl. ..... 439/237; 439/557

[58] Field of Search ..... 439/226-244, 439/555, 557

[56] References Cited

U.S. PATENT DOCUMENTS

| | | | |
|---|---|---|---|
| 2,337,267 | 12/1943 | Owen | 173/339 |
| 3,116,098 | 12/1963 | Kulka | 339/56 |
| 3,169,815 | 2/1965 | Lennox | 339/52 |
| 3,245,026 | 4/1966 | Pistey | 339/55 |
| 3,285,548 | 11/1966 | Matto et al. | 439/555 |
| 3,327,281 | 6/1967 | Johnson | 339/56 |
| 3,681,593 | 8/1972 | Genovese et al. | 240/51.11 R |
| 3,685,003 | 8/1972 | Watt | 339/56 R |
| 3,752,977 | 8/1973 | Davis | 240/51.12 |
| 4,687,276 | 8/1987 | Stockmaster | 439/557 |
| 4,713,019 | 12/1987 | Gaynor | 439/232 |

*Primary Examiner*—Larry I. Schwartz
*Assistant Examiner*—Hien D. Vu
*Attorney, Agent, or Firm*—Kramer, Brufsky & Cifelli

[57] ABSTRACT

A one-piece, molded plastic spring clip, which is substantially inverted U-shape in cross-section, has a bight portion including an opening receiving a screw threaded fastener to attach the clip to the rear surface of a lamp holder so that the screw threaded fastener does not extend from the clip through a headed flange portion of a lamp holder to provide a liquid conduit which could potentially short the lamp. The clip is provided with legs extending from either side of the bight and each leg has a pair of spaced, parallel wing portions extending outwardly from its associated leg to expand when inserted through the mounting plate. The wing portions provide vertical shoulders to seat the lamp holder on a vertical support in conjunction with a compressible coil spring provided on the opposite side of the mounting panel or vertical support between the headed flange and support to exert pressure on the clip shoulders against the rear of the mounting panel. A second non-compressible lamp holder is provided for the opposite end of the lamp on a second mounting panel. A one-piece, molded plastic spring clip is also provided for mounting the second lamp holder in a similar fashion, but is provided with flanges extending outwardly from the bottom of each leg, parallel to the bight portion so that the lamp will exert an axial force on the clip under the spring pressure of the compressible spring associated with the other lamp holder to clamp it to the front surface of the second mounting panel.

4 Claims, 2 Drawing Sheets

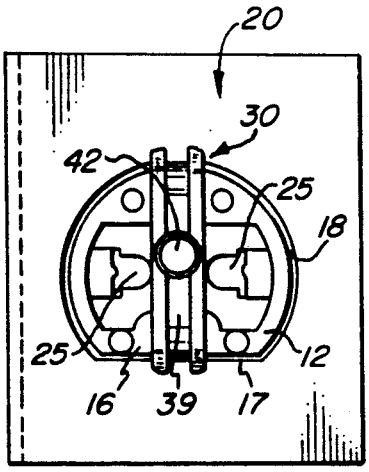
FIG. 4
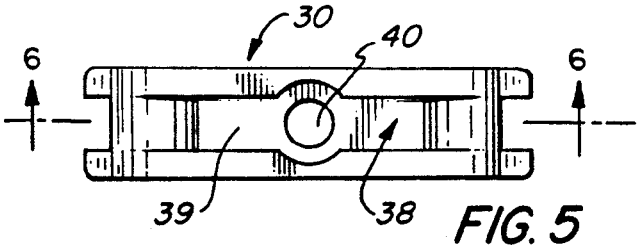
FIG. 5
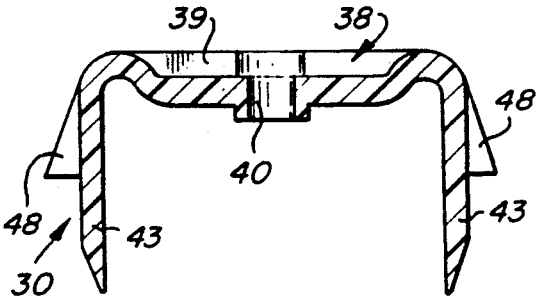
FIG. 6
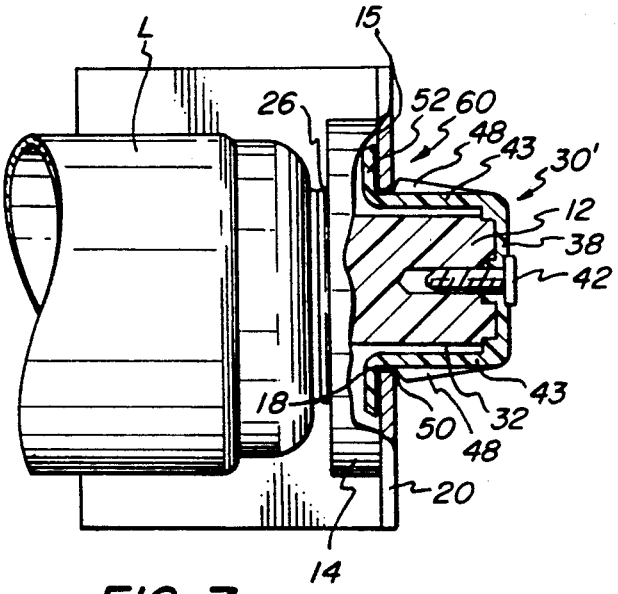
FIG. 7
FIG. 8
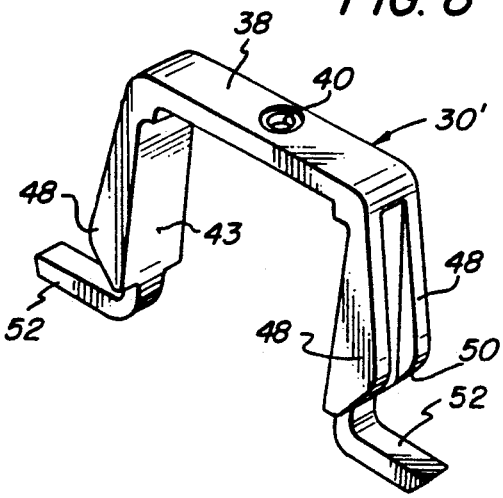

FLOURESCENT LAMP HOLDER MOUNT

This application is a continuation of application Ser. No. 565,271, filed Aug. 9. 1990.

BACKGROUND OF THE INVENTION

1. Field of the Invention

This invention relates generally to electrical connectors, and more particularly, to a mounting for a pair of spaced lamp holders or receptacles for receiving double-ended gaseous discharge lamps of the fluorescent type.

2. Description of the Prior Art

To facilitate mounting of a fluorescent electrical fixture, it is current practice to provide lamp holders (or receptacles) in sets or pairs, with one of the lamp holders being stationarily mounted or substantially so, and the other being axially compressible to a substantial degree, to facilitate the insertion of the lamp ends in the lamp holders. After insertion of the lamp ends in the lamp holders, the compressible lamp holder exerts an axial pressure upon the lamp, causing it to tightly engage at its respective ends in the lamp holders of the set.

The lamp holders are mounted on spaced mounting plates, usually by means of a spring clip. Typical of lamp holder patents illustrating the lamp holders and their mountings are Kulka, U.S. Pat. No. 3,116,098 issued Dec. 21, 1963, and Genovese et al., U.S. Pat. No. 3,681,593 issued Aug. 1, 1972. In both of these patents, the compressible lamp holder is of the snap-in type, that is to say, the lamp holder is equipped with a spring clip that permits the lamp holder to be snapped into a mounting panel as a labor-saving expedient. Further, such spring clip mountings facilitate the release of the lamp holder from the mounting panel from the front of the panel, which is desirable, for example, if the lamp holder should malfunction or should otherwise become faulty in operation. While the metal spring clips of both Kulka and Genovese et al. accomplish these functions, they do present other drawbacks.

Specifically, in Kulka, the metal spring clips for attaching the lamp holder to the mounting panel is connected to the lamp holder by means of rivets which extend through aligned openings or apertures in the front face of a mounting flange of the lamp holder to the rear surface of the flange. It has been found that if the lamp holder is mounted outdoors, water can accumulate in the aperture housing the rivet and there is a substantial chance that an electrical short can develop to ground through the face rivet and metal mounting clip. Accordingly, it is necessary to eliminate the spring clip mounting wherein it is attached by rivets to the face of the lamp holder. Genovese et al. accomplishes this by providing a one-piece spring metal mounting clip which is mounted to the rear of the lamp holder by a threaded fastener, thus eliminating the need to mount separate spring legs by rivets to the face of the lamp holder flange. However, it is still possible to develop an electrical short to ground through the spring metal clip, particularly where the lamp holder is compressible against the mounting plate through use of a coil spring surrounding the lamp holder between the metal plate and the flange of the lamp holder. The coil spring is virtually in contact with or slightly spaced from the end of the metal mounting clip and provides a spark gap which can be crossed to short the lamp to ground. Further, although the lamp holder is formed from an electrical insulative material, such as molded plastic or the like, it has been found that current can migrate through the lamp holder to the metal clip to ground to form an electrical short to ground discharging the lamp mounted to the lamp holder.

SUMMARY OF THE INVENTION

In order to eliminate the problems associated with the prior art, but to retain their desirable features, the present invention utilizes a one-piece spring clip, which is substantially inverted U-shape in cross-section. The bight portion or control strap of the clip includes an opening receiving a screw threaded fastener to attach the clip to the rear surface of the lamp holder so that the screw threaded fastener does not extend from the clip through the headed flange portion of the lamp holder to provide a liquid conduit which could potentially short the lamp. The clip is provided with resilient legs extending from either side of the bight and each leg has a pair of spaced, parallel wing portions extending outwardly from and diverging with respect to its associated leg to seat the lamp holder on a vertical support. The wing portions terminate in an abutment shoulder for the clip against the rear surface of a mounting panel through which the clip legs are inserted and when a compressible coil spring is provided on the opposite side of the mounting panel or vertical support between a flange of the lamp holder and front surface of the mounting panel, pressure is exerted to seat the abutment shoulders on the clip against the rear surface of the mounting panel.

On the non-compressible side of the mounting panel, the clip is also provided with flanges extending outwardly from the bottom of each leg, parallel to the bight portion so that the axially biased lamp will exert a force on the second lamp holder receiving the opposite end of the lamp to clamp the flanges of the clip to the front surface of its associated mounting panel.

The clip is molded from a resilient plastic so that the legs can be moved towards each other to clear the wings from the rear of the mounting panel enabling removal of the clip and its associated lamp holder from its mounting on the mounting panel, but since it is molded from a resilient plastic forming an electrical insulation material, the potential for it to form an electrical short to ground the lamp is completely eliminated, even if it is spaced a small distance from the compressible metal coil spring. The mounting clip, being formed from molded plastic, also readily lends itself to mass production for greater efficiency of manufacture than forming and bending a spring metal clip.

BRIEF DESCRIPTION OF THE DRAWINGS

Further objects and advantages of the present invention will become apparent from the following description and claims, and from the accompanying drawings, wherein:

FIG. 4 is a rear view in elevation of the mount of FIG. 2 as seen from the left-hand side of FIG. 2;

FIG. 5 is a top plan view of the clip comprising a portion of the compressible lamp holder mount of FIGS. 2, 3 and 4;

FIG. 6 is a cross-sectional view taken substantially along the plane indicated by line 6—6 of FIG. 5;

FIG. 7 is an enlarged view, partly in section, of the right-hand side of FIG. 1, illustrating the mount for the non-compressible lamp holder; and FIG. 8 is a perspective view of the clip comprising a portion of the non-compressible lamp holder mount of FIG. 7.

DETAILED DESCRIPTION OF THE PREFERRED EMBODIMENT

Figure 1:
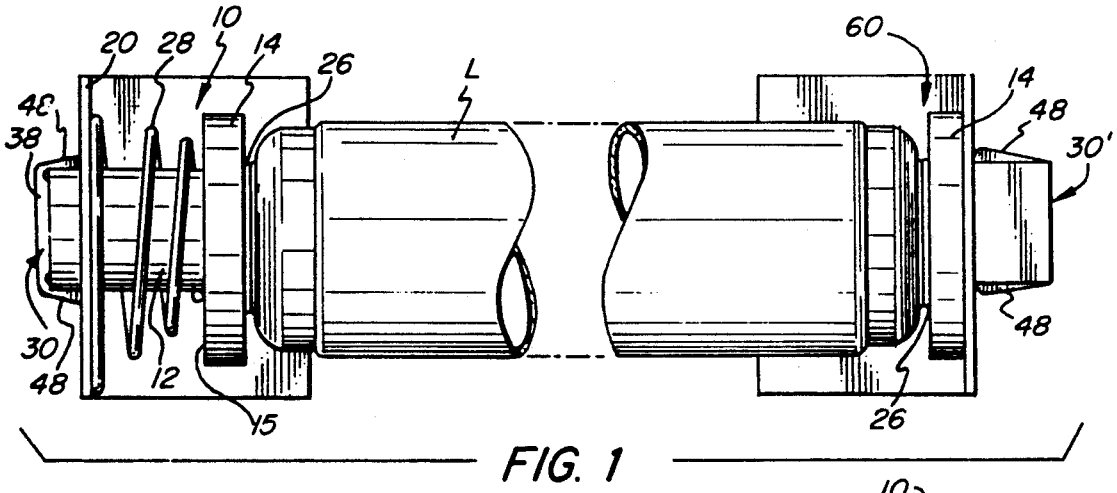
FIG. 1 is a front view in elevation of a pair of spaced lamp holders for a fluorescent lamp mounted on spaced mounting plates with the mount of the present invention.

Referring now to the drawings in detail wherein like numerals indicate like elements throughout the several views, a compressible lamp holder 10 comprising a portion of the present invention includes a body 11 of electrical insulation material, such as a molded plastic or the like, having a cylindrical body portion 12 integral at its front end with an enlarged, flat collar or flange constituting a head portion 14 the underside of which comprises an abutment 15. The body portion 12 is formed (see FIG. 4) with a flat 16, corresponding to a flat edge 17 of an otherwise circular mounting opening 18 formed in a mounting plate 20, which may constitute a portion of an electrical fixture in which one end of a double-ended gaseous discharge lamp L is supported.

Formed in the front surface of head portion 14 is a recess 22 for and end of lamp L, and provided in the recess is a partition 24 for lamp contacts (not shown), which are connected to leads (not shown) which project out of the rear end of the body portion 12 through openings 25. Within recess 22, the partition 24 is integrally molded in body portion 12 as part thereof. Recess 22 has an annular shoulder 27 forming an annular groove in the head portion 14 adapted to receive a gasket 26 as a seal between the lamp L and holder 10.

The construction so far described is already known, as may be readily noted by reference to Kulka U.S. Pat. No. 3,116,098 and Genovese et al. U.S. Pat. No. 3,681,593. Also known to the prior art, as seen from these patents, is a compression coil spring 28, the convolutions of which are normally widely spaced as shown in FIG. 1, said convolutions being progressively increased in diameter in a direction away from the head portion 14. At its front end, spring 28 bears against abutment 15. The smallest convolution can be formed of a diameter so as to grip the body portion 12, to hold the coil spring 28 assembled with the body 11 of the lamp holder 10 awaiting use.

Generally designated at 30 is a retaining or mounting clip. Clip 30 is formed from a single piece of molded plastic.

Referring to FIG. 4, clip 30 extends diametrically across the rear end of the body 11, which is formed with a diametrically extended recess 32 receiving the clip 30 and defining opposed walls or abutments 34 to prevent relative rotational movement of the clip 30 and body 11. At the opposite ends of the clip, the recess 32 is formed with end portions or extensions of greater depth in a direction axially of body portion 12.

Clip 30, which is substantially inverted U-shape in cross-section, as shown to best advantage in FIGS. 5 and 6, is formed having a bight portion 38 provided with a linear, elongated embossed or depressed intermediate or central portion 39, having medially between its ends an aperture 40 through which extends a screw 42 or equivalent fastening means, engaged in the rear of body portion 12 for the purpose of fixedly securing the clip 30 to the body portion 12. The embossed central portion 39 of bight 38 strengthens the clip 30 and merges at its opposite ends into leg portions 43 of the clip. Each leg 43 has a pair of spaced, parallel forwardly extending wing members 48, which are inclined so as to converge in a direction extending rearwardly from the head portion 14 of the body 11.

At their forward ends, the wing members 48 merge into inwardly extending shoulders 50, which are substantially parallel with the bight portion 38. Shoulders 50, at their inner ends, in turn merge into forwardly projecting leg members 43, which are received within the recess 32 of body portion 12.

The leg portions 43 of the clip 30 being resilient, can be moved towards each other against the inherent tension of the material thereof in recess 32, passed through mounting opening 18 in mounting plate 20, and allowed to expand so that shoulders 50 of wing portions 48 abut the rear surface of plate 20. If necessary, a selected one or both of the spring legs 43 can be pressed inwardly by a tool or instrument held by the user, when the holder 10 is to be removed.

Figure 2:
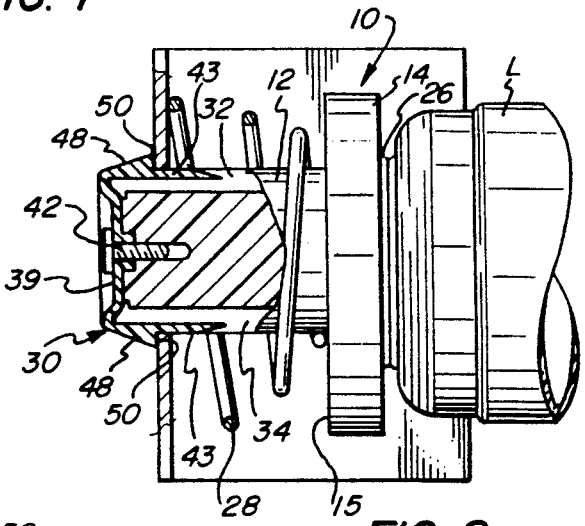
FIG. 2 is an enlarged view, partly in section, of the left-hand side of FIG. 1 illustrating the mount for the compressible lamp holder.
Figure 3:
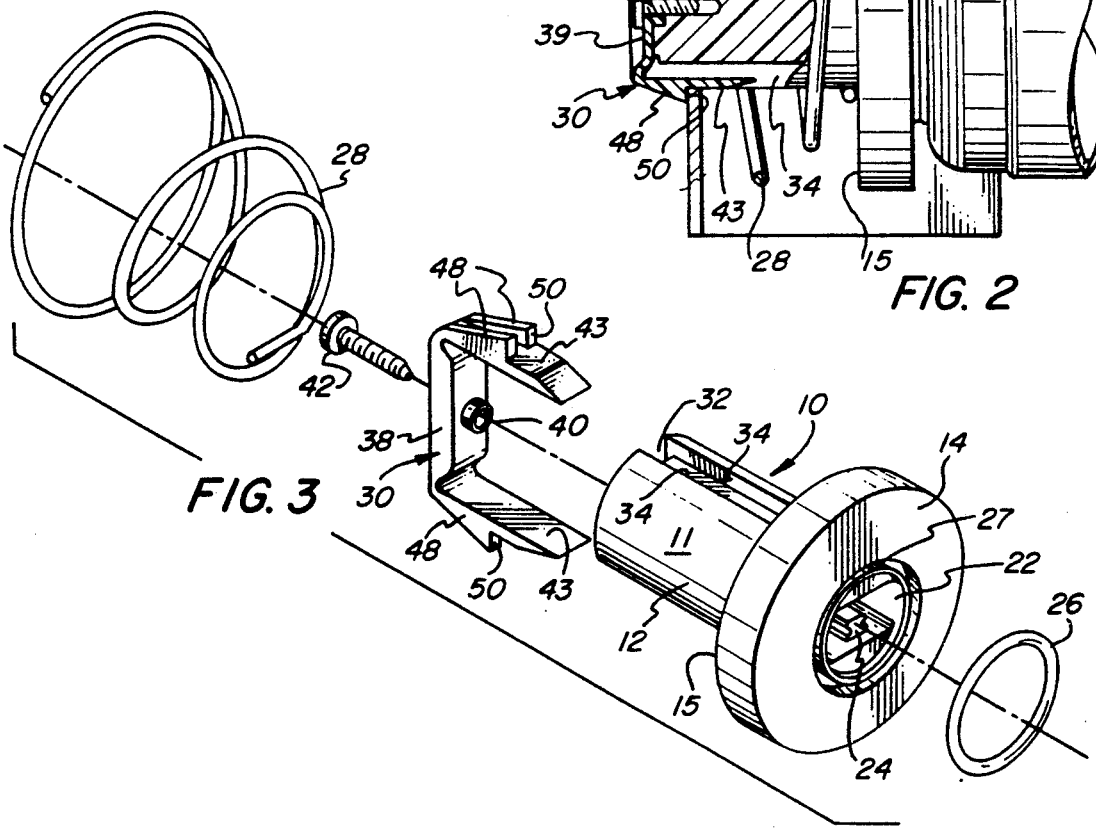
FIG. 3 is an exploded perspective view of the compressible lamp holder mount of the present invention illustrated in FIG. 2.

In use, one mounts the compressible lamp holder 10 merely by inserting it through the mounting holder opening 18 in a direction toward the left in FIG. 2. As a result, the opposite edges of the mounting holder opening 18 bear against the inclined wing members 48, camming them radially inwardly until the members 48 clear the edges of the mounting hole 18, into snapping engagement with the back surface of the mounting plate. Then, the lamp holder 10 can be considered as mounted, by reason of the fact that the act of inserting the body through the mounting hole 18 compresses the coil spring 28 between mounting panel 20 and abutment 15. Spring 28, tending to expand, causes shoulders 50 to bear firmly against the back surface of the mounting panel 20 to clamp the lamp holder 10 to the mounting panel 20.

The opposite end of lamp L is received first in a substantially identical, although non-compressible, lamp holder 60 (FIG. 7) wherein like elements corresponding to lamp holder 10 are indicated by identical elements. While body portion 12 of lamp holder 60 is shorter because of the absence of coil spring 28, the remaining elements are identical to those of lamp holder 10 except for mounting clip 30'. Clip 30' has all the elements of clip 30 and is mounted in holder opening 18 of a mounting plate 20 in the same fashion as clip 30. In addition, the ends of leg members 43 of clip 30' are provided with oppositely extending, lateral flanges 52 parallel to a flat bight portion 38. After insertion of clip 30' and clip 30 in opposed mounting plates 20, the axial force of spring 28 exerted on lamp L clamps the flanges 52 against the front surface of its associated mounting plate 20.

The device is now ready for use, and can be temporarily compressed whenever a lamp L is to be engaged by the lamp holder 10.

To remove either lamp holder, as for example when the lamp holder needs replacement, one may insert a screwdriver bit between shoulder 50 and the end of the elongated portion of the leg member 43. With the screwdriver bit so positioned one simply presses inwardly against the leg, temporarily causing shoulder 50 thereof to clear the edge of the mounting hole 18. The other side can be similarly pressed inwardly, until the lamp holder is sufficiently clear of the mounting hole to permit it to be removed. This is accomplished with maximum speed and ease.

What is claimed is:

1. A fluorescent lamp holder pair adapted for engagement in spaced electrically conductive support panels, each panel having a mounting opening and front and back surfaces, said lamp holder pair including a first and second spaced lamp holder, each having:

a body portion having front and rear ends;

a head portion at the front end of the body portion having a forwardly opening recess adapted to receive and hold a fluorescent lamp in sealed relationship, said head portion providing a rearwardly facing abutment at the front end of the body portion; and lamp contact means in said recess;

a compression coil spring on the body portion of said first lamp holder and bearing at one end against said abutment, the other end of the spring being free for compression of the spring between the front surface of an electrically conductive support panel and the head portion; and a molded plastic, unitary mounting clip for mounting each of said first and second lamp holders in one of said spaced, electrically conductive support panels, said clip substantially eliminating electrical shorting to ground including a pair of legs connected by a strap adapted to receive a fastener therethrough to mount said clip to the rear of said body portion, each leg being partially recessed within the rear end and side of the body portion of a lamp holder, said legs having wing portions diverging forwardly from said strap and being formed at their divergent ends with shoulder projecting substantially radially outwardly beyond the circumference of the body portion for abutment with the back surface of one of said support panels, said clip precluding shorting from current migration through the lampholder, compression coil spring and clip to ground.

2. The lamp holder pair of claim 1 wherein the mounting clip of said second lamp holder includes an oppositely extending flange on the terminal portion of each leg substantially parallel to said connecting strap, the shoulders of said wing portion and flanges being disposed on opposite sides of a support panel.

3. A lamp holder as in claim 1 wherein said fastener is a threaded fastener.

4. A fluorescent lamp holder pair as defined in claim 1 wherein the head portion at the front end of the body portion of each of the first and second lamp holders is rivotless.

* * * * *